US006347924B1

(12) United States Patent
Chang

(10) Patent No.: US 6,347,924 B1
(45) Date of Patent: Feb. 19, 2002

(54) COMBINATION OF BLADE BRACKET AND MOTOR CASING FOR CEILING FANS

(76) Inventor: Pin Tsung Chang, No. 24, Lane 305, Fwu Shan Street, Changhua City (TW)

( * ) Notice: Subject to any disclaimer, the term of this patent is extended or adjusted under 35 U.S.C. 154(b) by 0 days.

(21) Appl. No.: 09/709,632

(22) Filed: Nov. 13, 2000

(51) Int. Cl.[7] ..... F04D 29/34
(52) U.S. Cl. ..... 416/210 R; 416/221
(58) Field of Search ..... 416/210 R, 5, 416/204 R, 205, 206, 207, 220 A, 221; 403/381, 319

(56) References Cited

U.S. PATENT DOCUMENTS 6,139,276 A * 10/2000 Blateri et al. ..... 416/210 R

* cited by examiner

*Primary Examiner*—F. Daniel Lopez
*Assistant Examiner*—James M. McAleenan
(74) *Attorney, Agent, or Firm*—Bacon & Thomas, PLLC

(57) ABSTRACT

An engaging ring on a motor casing of a ceiling fan has a plurality of slots defined in an underside thereof and each slot is located between two sidewalls extending from the engaging ring. A boss extends from an inner top surface defining each slot and each slot has a plurality of U-shaped spring received therein. A blade bracket has a block extending therefrom and each block includes an elongate head and an elongate neck. A lengthwise distance of each elongate neck is longer than a distance between the two legs of each spring so that the two legs of the spring are widened by the elongated neck to securely position the bracket in the slot.

4 Claims, 7 Drawing Sheets

COMBINATION OF BLADE BRACKET AND MOTOR CASING FOR CEILING FANS

FIELD OF THE INVENTION

The present invention relates to a combination between the blade bracket and the motor casing for ceiling fans.

BACKGROUND OF THE INVENTION

A conventional combination between blade brackets and a motor casing for ceiling fans known to applicant is shown in FIG. 6 and generally includes an engaging plate 52 on a lower end of the motor casing 51, and threaded holes 521 are defined in the engaging plate 52. Each blade bracket 531 is connected to a blade 54 by a shank 53, and two holes 532 are defined through the bracket 531 so that the bracket 531 is fixed to the plate 52 by bolts 533 extending through the holes 532 and engaged with the threaded holes 521. The connection between the brackets 531 and the plate 52 by bolts 533 could be loosened and that will cause dangerous results. Another engagement is disclosed in U.S. Pat. No. 6,048,173 to Tsai, the assignee with the title of "engagement of blade brackets and the motor casing for a ceiling fan". As shown in FIG. 7, the U.S. Pat. No. 6,048,173 disclosed a bracket 631 with two inclined side and the engaging plate 62 has tapered-shaped recesses 621 so that the brackets 631 is securely engaged with the recesses 621 by centrifugal force. However, this engagement requires a precise machining work to make sure that the brackets 631 is snugly engaged with the recesses 621, or the coating on the brackets 631 and the inside of the recesses 621 could be peeled off and get rust therein.

SUMMARY OF THE INVENTION

In accordance with one aspect of the present invention, there is provided a combination of blade brackets and motor casing for ceiling fans. An engaging ring is connected to the motor casing and a plurality of slots are defined in an underside of the engaging ring. Each slot is located between two sidewalls extending from the underside of the engaging ring and a first notch is defined in an inside of the close end defining each slot so as to receive a U-shaped spring therein. A boss extends from an inner top surface defining each slot and a recess is defined in the inner top surface defining each slot and opens to the inner periphery of the engaging ring so that a positioning space is defined between a section of the boss and the an inner top surface defining the recess. Each blade bracket has a block extending therefrom and each block includes an elongate head and an elongate neck which is engaged between the two legs of the spring. The elongate head is received in the positioning space in each slot. A lengthwise distance of each elongate neck is longer than a distance between the two legs of each spring so that the two legs of the spring are widened by the elongated neck. An end plate extends from each blade bracket and is located in opposite to a blade connected to the blade bracket. Each end plate has two inclined sides so that when rotating the bracket to let the two legs of the spring widened, the two inclined sides are pushed by the two sidewalls.

The primary object of the present invention is to provide a combination between the blade bracket and the motor casing wherein a spring is received in each slot and clamps a boss of each blade bracket.

These and further objects, features and advantages of the present invention will become more obvious from the following description when taken in connection with the accompanying drawings.

DETAILED DESCRIPTION OF THE PREFERRED EMBODIMENT

Figure 1:
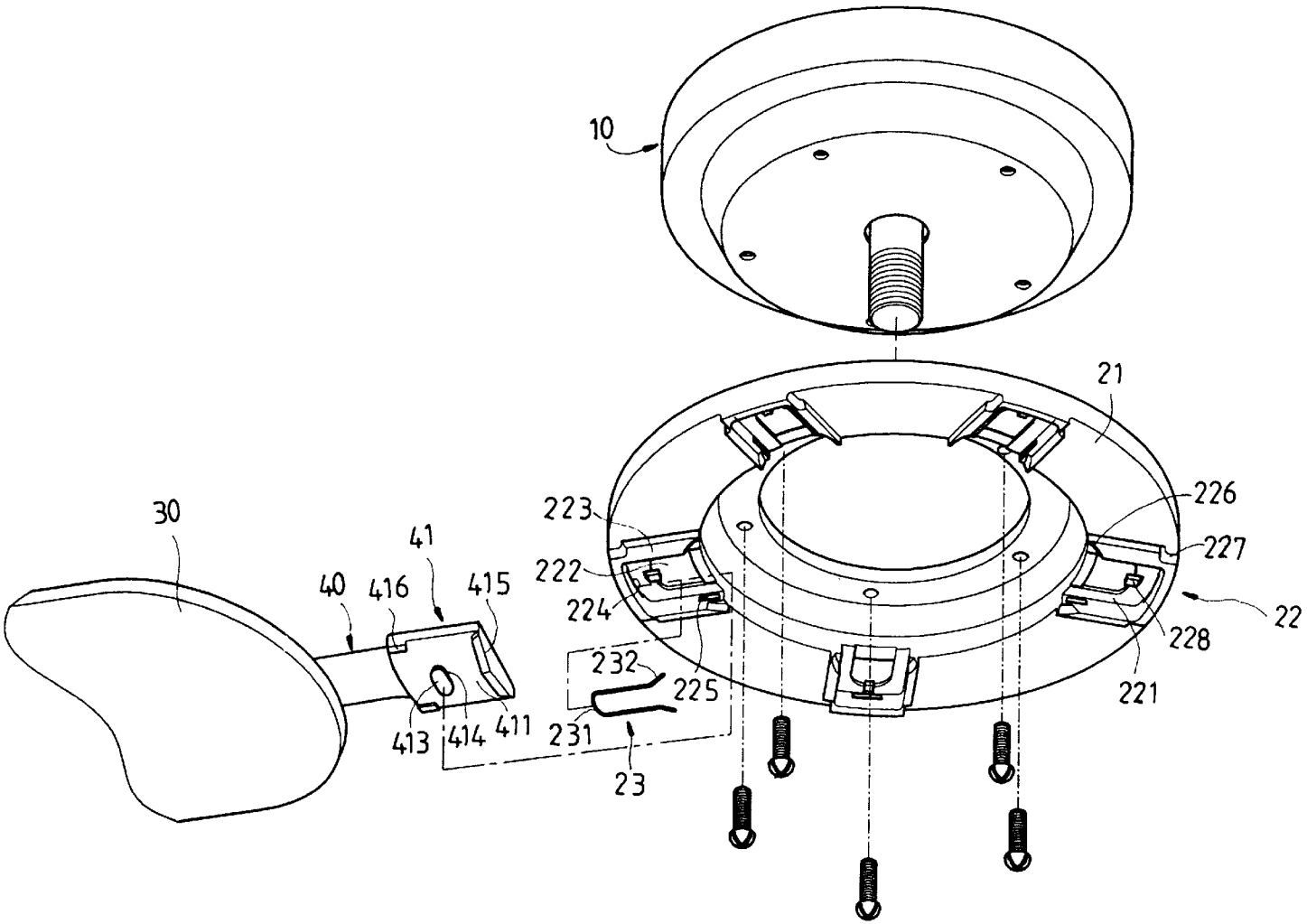
FIG. 1 is an exploded view to show a blade bracket and an engaging ring on a motor casing of the ceiling fan of the present invention.
Figure 2:
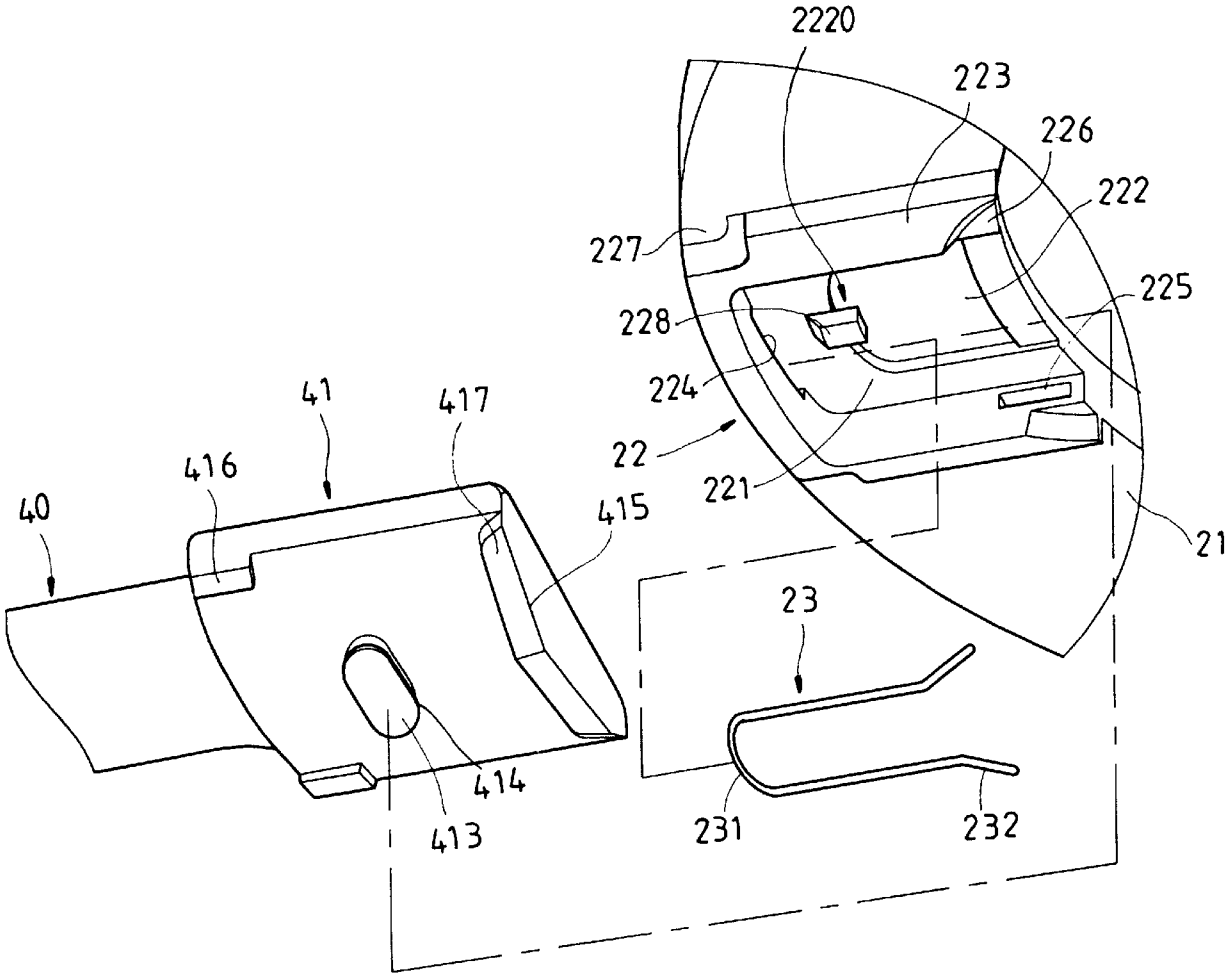
FIG. 2 is an enlarged and exploded view to show the blade bracket and the slot in the engaging ring of the present invention.
Figure 5:
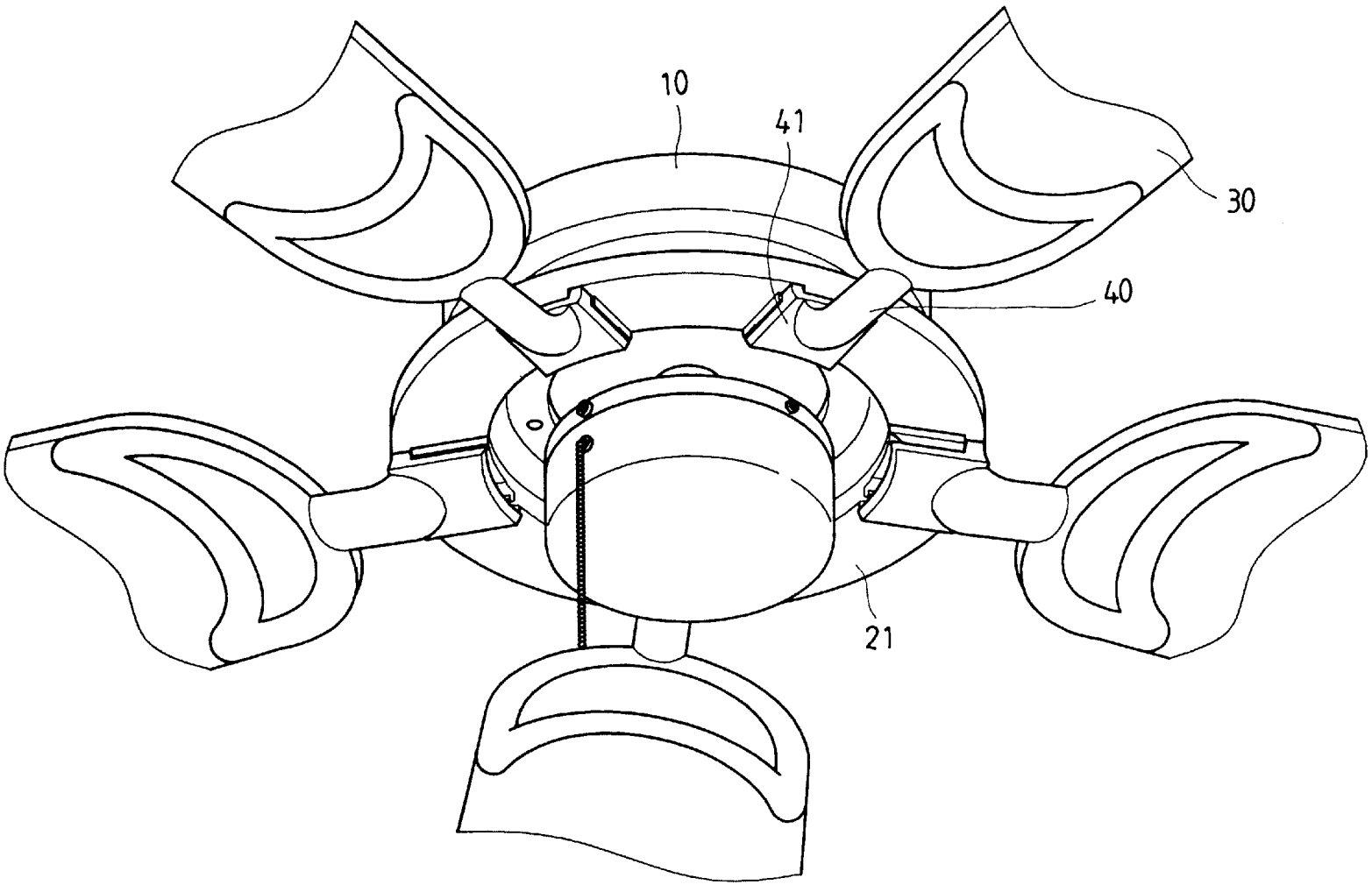
FIG. 5 is a perspective view seen from bottom of the ceiling fan of the present invention.
Figure 6:
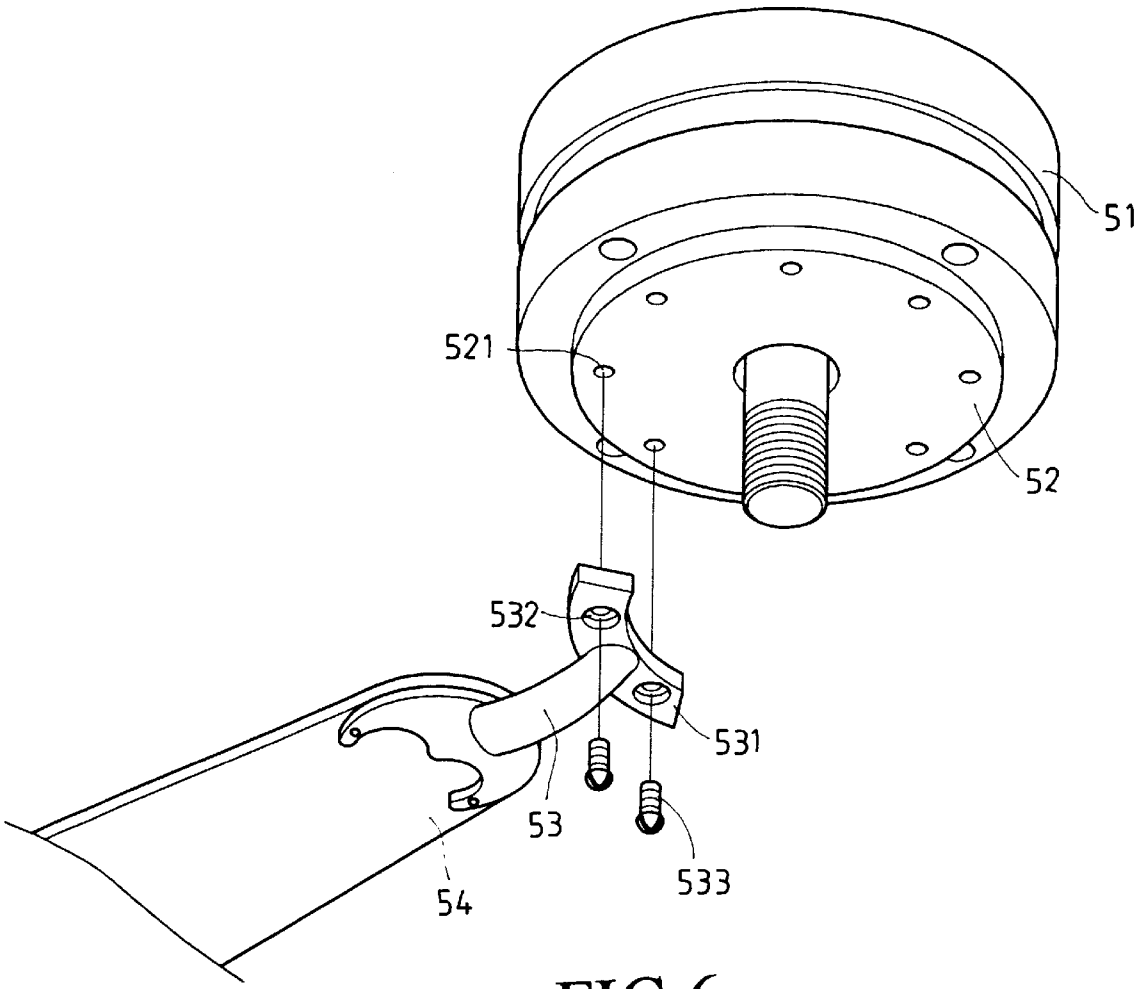
FIG.6 PRIOR ART
FIG. 6 is an exploded view to show a conventional blade bracket and a motor casing.
Figure 7:
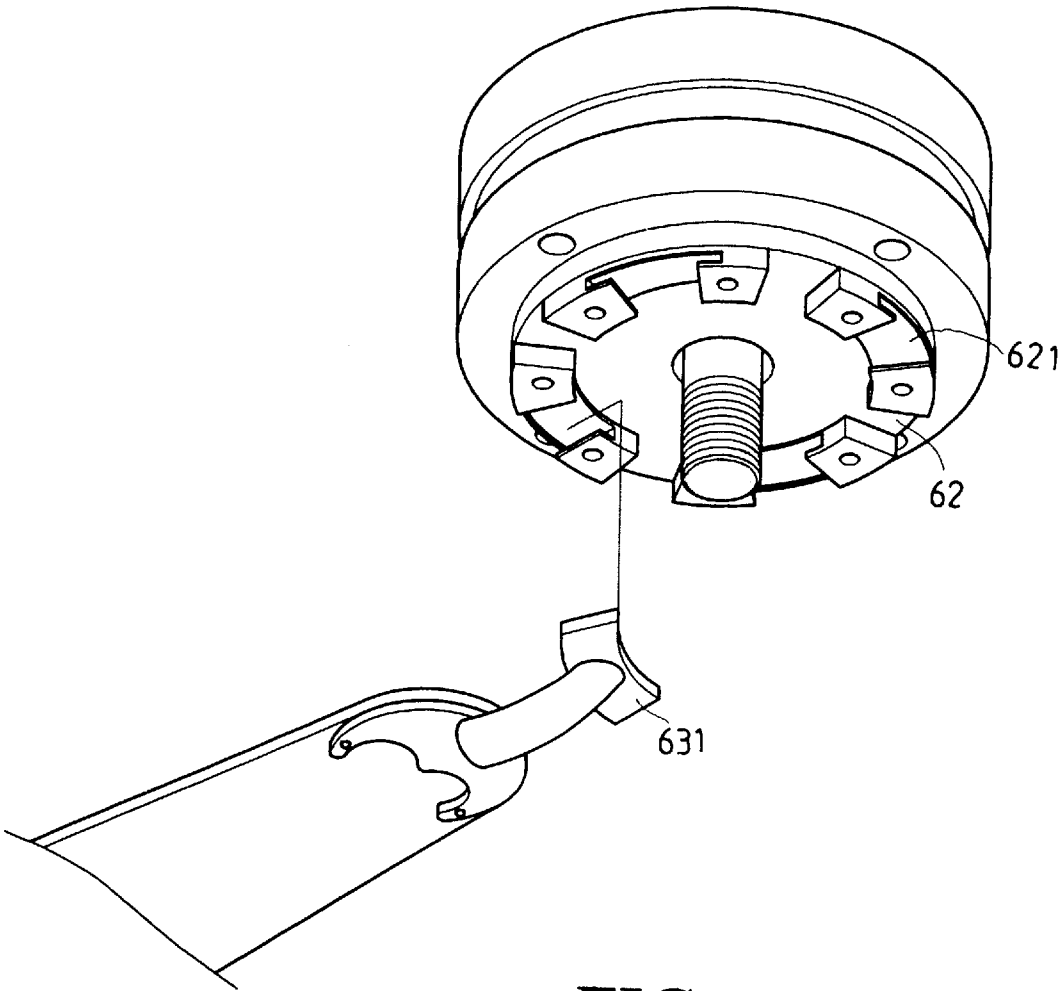
FIG.7 PRIOR ART
FIG. 7 is another embodiment of a conventional blade bracket and a motor casing.

Referring to FIGS. 1, 2 and 5, the ceiling fan of the present invention comprises an engaging ring 21 connected to the motor casing 10 and a plurality of slots 22 are defined in an underside of the engaging ring 21 so that blade brackets 41 are respectively engaged with the slots 22. Each blade bracket 41 is connected to a blade 30 by a connection link 40. Each slot 22 opens to an inner periphery and the underside of the engaging ring 21 and closes at an outer periphery of the engaging ring 21. Each slot 22 is located between two sidewalls 223 extending from the underside of the engaging ring 21. A first notch 224 is defined in an inside of the close end defining each slot 22 and a boss 228 extends from an inner top surface 221 defining each slot 22. A recess 222 is defined in the inner top surface 221 defining each slot 22 and opens to the inner periphery of the engaging ring 21 so that a positioning space 2220 is defined between a section of the boss 228 and the an inner top surface defining the recess 222. Two engaging holes 225 are respectively defined in the two opposite inner sides defining each slot 22 and two concavities 226 are respectively defined in the two opposite inner sides defining each slot 22 and located close to the inner periphery of the engaging ring 21. A recessed area 227 are defined in an outside of each sidewall 223.

A plurality of U-shaped springs 23 each have a close end 231 which is engaged with the notch 224 in each slot 22 and two legs of each spring 23 are respectively engaged with the two engaging holes 225 in the two opposite inner sides defining each slot 22.

Each blade bracket 41 has a block 413 extending therefrom and each block 413 includes an elongate head 414 and an elongate neck 412 which is connected between the elongate head 414 and the blade bracket 41. An end plate 415 extends from each blade bracket 41 and is located in opposite to the blade 30. Each end plate 415 has two inclined sides 417. Two protrusions 416 extend from two opposite sides of each blade bracket 41.

Figure 3A:
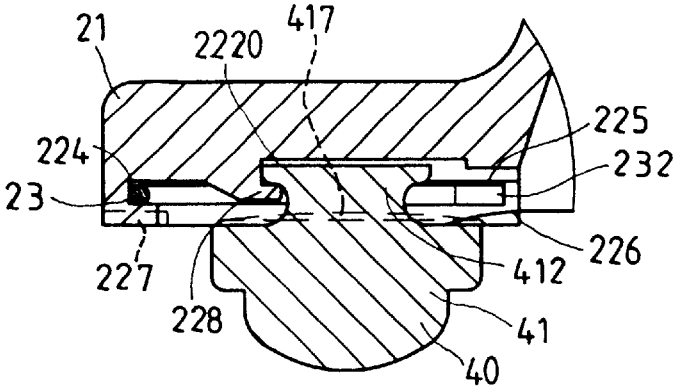
FIG. 3A is a cross sectional view to show the blade bracket is received in the slot in the engaging ring.
Figure 3B:
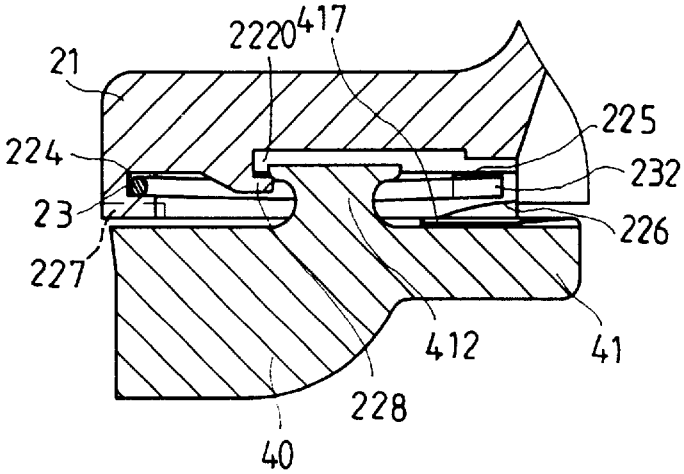
FIG. 3B is a cross sectional view to show the blade bracket received in the slot is rotated 90 degrees to expand the spring in the slot.
Figure 3C:
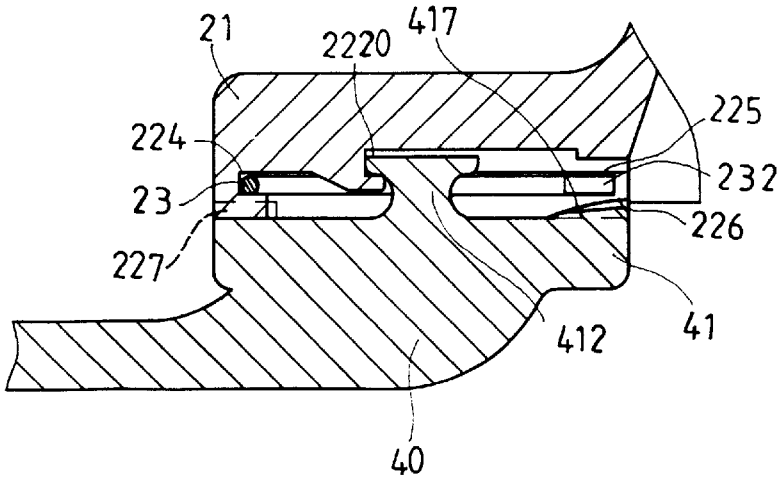
FIG. 3C is a cross sectional view to show the blade bracket is engaged with the slot by receiving two ends of the end plate in the two concavities in the slot.
Figure 4A:
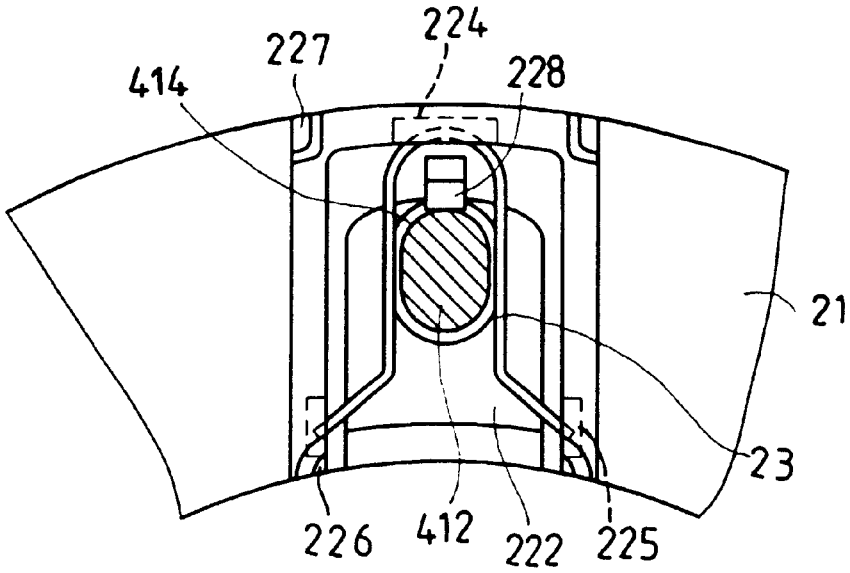
FIG. 4A shows the elongate neck is engaged between two legs of the spring in the slot.
Figure 4B:
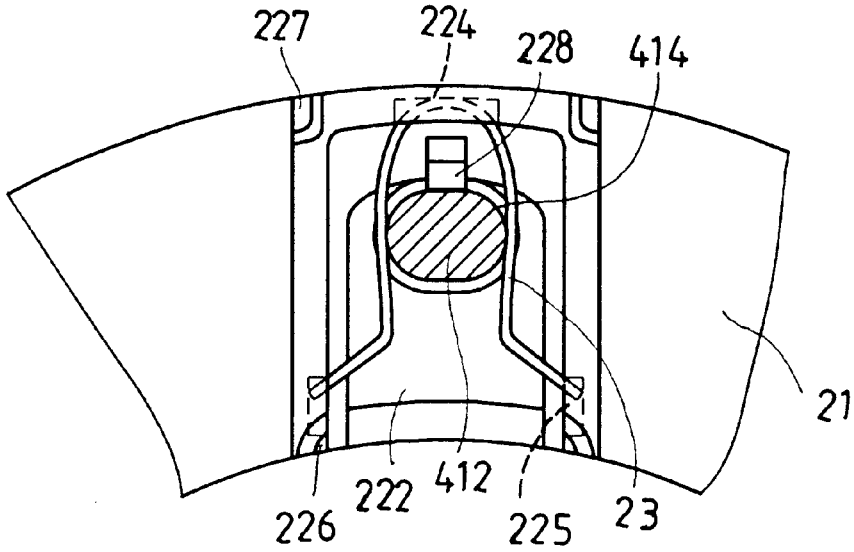
FIG. 4B shows the elongate neck is rotated to expand the two legs of the spring in the slot.

As shown in FIGS. 3A and 4A, the blade bracket 41 is first received in the slot 22 with the elongate head 414 received in the positioning space 2220 in each slot 22 and the elongate neck 412 engaged between the two legs of the spring 23. It is to be noted that a lengthwise distance of each elongate neck 412 is longer than a distance between the two legs of each spring 23 so that when the blade bracket 41 is first received in the slot 22, the lengthwise direction of the block 413 is parallel with the two legs of the spring 23 as shown in FIG. 4A. The blade bracket 41 is then rotated 90 degrees, referring to FIGS. 3B and 4B, the two legs of the spring 23 are then expanded and widened by the rotation of the elongate neck 412. The two inclined sides 417 of the end plate 415 are pushed by the two sidewalls 223 (as shown in FIG. 3B) to let the blade bracket 41 lowered. When the blade bracket 41 is rotated 90 degrees, an orientation of the blade bracket 41 is complied with the slot 22 and two ends of the end plate 415 are engaged with the two concavities 226 in each slot 22, and the two protrusions 416 of the blade bracket 41 are engaged with the recesses areas 227. The spring 23 secures the elongate neck 412 to position the blade bracket 41.

The blade brackets 41 are securely engaged with the slots 22 by the centrifugal force when the ceiling fan rotates and the springs 23 clamp the elongate necks 412 of the blade brackets 41 to fix the blade brackets 41 in the slots 22.

While we have shown and described various embodiments in accordance with the present invention, it should be clear to those skilled in the art that further embodiments may be made without departing from the scope and spirit of the present invention.

What is claimed is:

1. A combination of blade brackets and motor casing for ceiling fans, comprising:

an engaging ring (21) connected to said motor casing (10) and a plurality of slots (22) defined in an underside of said engaging ring (21), each slot (22) opening to an inner periphery and said underside of said engaging ring (21) and closing at an outer periphery of said engaging ring (21), each slot (22) located between two sidewalls (223) extending from said underside of said engaging ring (21), a first notch (224) defined in an inside of said close end defining each slot (22) and a boss (228) extending from an inner top surface (221) defining each slot (22), a recess (222) defined in said inner top surface (221) defining each slot (22) and opening to said inner periphery of said engaging ring (21), a positioning space (2220) defined between a section of said boss (228) and said an inner top surface defining said recess (222);

a plurality of U-shaped springs (23) each having a close end (231) which is engaged with said notch (224) in each slot (22) and two legs of each spring (23) contacting against two opposite inner sides defining each slot (22), and each blade bracket (41) having a block (413) extending therefrom and each block (413) including an elongate head (414) and an elongate neck (412) which is connected between said elongate head (414) and said blade bracket (41), said elongate head (414) received in said positioning space (2220) in each slot (22) and said elongate neck (412) engaged between said two legs of said spring (23), a lengthwise distance of each elongate neck (412) being longer than a distance between said two legs of each spring (23) so that said two legs of said spring (23) are widened by said elongated neck (412), an end plate (415) extending from each blade bracket (41) and adapted to be located in opposite to a blade (30) connected to said blade bracket (41), each end plate (415) having two inclined sides (417).

2. The combination as claimed in claim 1 further comprising two engaging holes (225) respectively defined in said two opposite inner sides defining each slot (22) and two distal ends (232) of each spring (23) engaged with said two engaging holes (225).

3. The combination as claimed in claim 1 further comprising two concavities (226) respectively defined in said two opposite inner sides defining each slot (22) and located close to said inner periphery of said engaging ring (21), two ends of each end plate (415) engaged with said two concavities (226) in each slot (22).

4. The combination as claimed in claim 1 further comprising two protrusions (416) extending from two opposite sides of each blade bracket (41) and a recessed area (227) defined in an outside of each sidewall (223), said protrusions (416) of each blade bracket (41) engaged with said recesses areas (227).

* * * * *